United States Patent [19]

Kim

[11] Patent Number: 4,816,809

[45] Date of Patent: Mar. 28, 1989

[54] SPEAKING FIRE ALARM SYSTEM

[75] Inventor: Jin-Seak Kim, Buchun-City, Rep. of Korea

[73] Assignee: Samsung Electronics Co., Ltd., Suweon, Rep. of Korea

[21] Appl. No.: 62,966

[22] Filed: Jun. 17, 1987

[30] Foreign Application Priority Data

Jun. 18, 1986 [KR] Rep. of Korea ..... 86-4855

[51] Int. Cl.[4] ..... G08B 25/02; G08B 17/00

[52] U.S. Cl. ..... 340/692; 340/584

[58] Field of Search ..... 340/692, 584, 628, 502, 340/599, 661, 506; 364/550

[56] References Cited

U.S. PATENT DOCUMENTS

| | | | |
|---|---|---|---|
| 4,531,114 | 7/1985 | Topol et al. | 340/628 X |
| 4,550,313 | 10/1985 | Kimura | 340/584 |
| 4,665,383 | 5/1987 | Desjardins | 340/692 X |
| 4,673,920 | 6/1987 | Ferguson et al. | 340/506 X |
| 4,682,348 | 7/1987 | Dawson et al. | 340/692 X |
| 4,709,330 | 11/1987 | Yokoi et al. | 340/573 X |

*Primary Examiner*—Glen R. Swann, III
*Assistant Examiner*—Thomas J. Mullen, Jr.
*Attorney, Agent, or Firm*—Robert E. Bushnell

[57] ABSTRACT

A speaking fire alarm system for not only giving an alarm in voice on an occurrence of a fire but also providing some information necessary for coping with the situations. The system includes a temperature sensor for sensing a surrounding temperature and providing a voltage responsive to the temperature sensed, comparator means for comparing the voltage supplied from the temperature sensor with a reference voltage and thereby providing a logic signal in accordance with its comparison, a central processing unit for receiving the logic signal from the buffer, thereby deciding the occurrence of the fire and providing both a fire alarm signal and message data according to an emergent situation, a voice synthesizer for providing address signals in accordance with the message data supplied from the central processing unit and also providing quantized voice messages which are synthesized from voice data received, voice memory for providing again to the voice synthesizer the voice data which is in advance stored in adequate format responsive to the address signals supplied from the voice synthesizer, voice output amplifying means for receiving the quantized voice messages supplied from the voice synthesizer for reshaping to smooth waveforms and amplifying to an adequate level, a host computer having a control program for controlling a plurality of slave fire control systems which are coupled to the host computer itself for detecting the fire alarm signal from each central processing unit and providing the fire alarm signal to remaining slave fire alarm systems.

26 Claims, 2 Drawing Sheets

SPEAKING FIRE ALARM SYSTEM

BACKGROUND OF THE INVENTION

This invention relates to a fire alarm system, and more particularly to a speaking fire alarm system which gives an alarm in voice on an occurrence of a fire and also provides some necessary information in voice for coping with the situation.

Almost all buildings are usually equipped with fire alarm systems by which the occurrence of a fire is warned of in time. Generally, the conventional fire alarm system gives a warning signal in siren or any other audible alarm means on the occurrence of a fire, either manually or automatically.

However, in case of emergency such as a sudden fire almost all of the people are thrown into extreme confusion, so that they would not find out where emergency exits, extinguishers or fire hydrants are located and would have great difficulty in coping with such a dangerous situation in the early stage. Moreover, it is much more difficult in the night time to get out of its fatal danger because it becomes nearly impossible to identify the surrounding environment in large buildings like hotels, offices and so on. Moreover after putting out the fire, there has always been much difficulty in finding out the cause of the occurrence of the fire.

SUMMARY OF THE INVENTION

It is therefore a principal object of this invention to provide a speaking fire alarm system which on an occurrence of a fire gives an alarm in voice with information and instructions to cope, along with information and instructions to cope with the situation.

It is another object of this invention to provide a speaking fire alarm system which enables an exact finding of a cause of the fire after putting out the fire.

These and other objects of the invention are achieved in a speaking fire alarm system for not only giving an alarm in voice on the occurrence of the fire and, but also providing some necessary information in voice to cope with the situation, comprising: temperature sensor for sensing a surrounding temperature and providing a voltage responsive to the temperature sensed; comparator means for comparing the voltage supplied from the temperature sensor with a reference voltage and thereby providing a logic signal in accordance with its comparison; buffer for buffering the logic signal supplied from the comparator means; central processing unit for receiving the logic signal from the buffer thereby deciding the occurrence of the fire and providing both a fire alarm signal and message data according to the situation arising; voice syntheizer for providing address signals in accordance with the message data supplied from the central processing unit and also outputing quantized voice messages which are synthesized from voice data received in; voice memory for providing again to the voice synthesizer the voice data which is in advance stored in adequate format responsive to the address signals supplied from the voice synthesizer; voice output amplifying means for receiving the quantized voice messages supplied from the voice synthesizer for reshaping to smooth waveforms and amplifying to an adequate level; and host computer having a control program for controlling a plurality of slave fire control systems which are coupled to the host computer itself for detecting the fire alarm signal from each central processing unit and providing the fire alarm signal to remaining slave fire alarm systems.

BRIEF DESCRIPTION OF THE DRAWINGS

The invention will be better understood with a reference to drawings, in which.

DETAILED DESCRIPTION OF THE INVENTION

Figure 1:
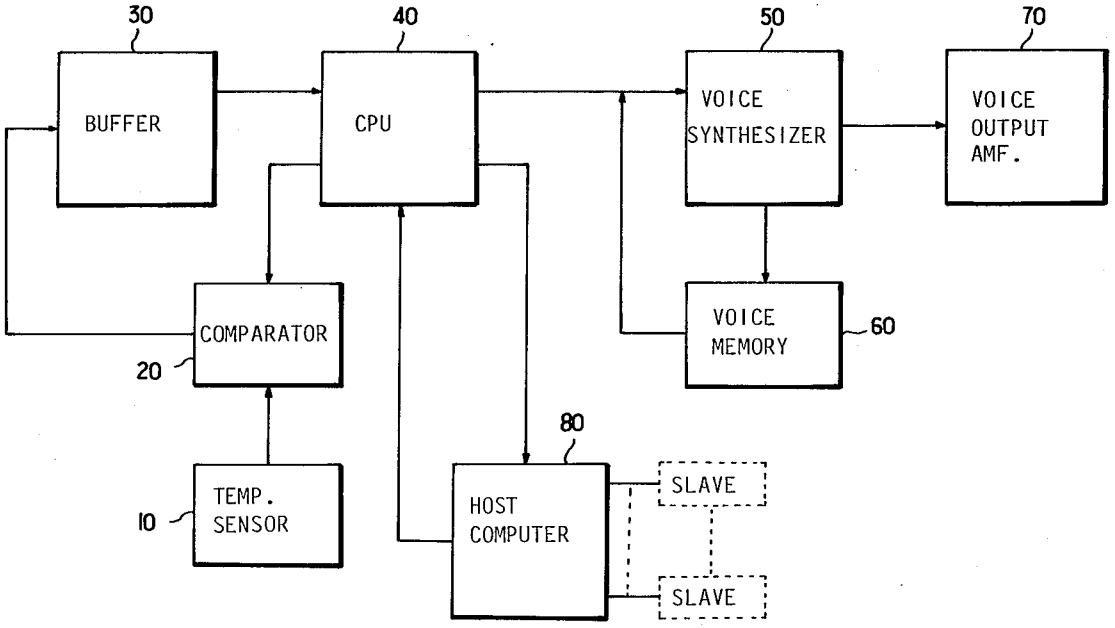
FIG. 1 is a block diagram representation of a fire alarm system embodying the invention.

FIG. 1 is a block diagram of a fire alarm system according to the present invention, and includes temperature sensor 10 for sensing a temperature and providing its corresponding voltage, comparator 20 for comparing the voltage supplied from the temperature sensor 10 with a reference voltage, buffer 30 buffering and inverting a signal supplied from the comparator 20, central processing unit 40 (hereinafter referred to as "CPU") for receiving the signal from the buffer 30 and providing a fire alarm signal and necessary message data in vector addressing according to the situation occurring, voice synthesizer 50 for providing address signals in accordance with the message data supplied from the CPU 40 and also outputing quantized voice messages by synthesizing voice data received in, voice memory 60 for providing the voice data to the voice synthesizer 50 in accordance with the address signals supplied from the voice synthesizer 50, voice output amplifier 70 for receiving the quantized voice messages supplied from the voice synthesizer 50 to reshape and amplify them, and host computer 80 having a control program for fire alarm operation. Computer 80 is coupled to each CPU 40 of a plurality of slave fire alarm systems for monitoring status of operations of the slave fire alarm circuits in accordance with execution of the control program and also detecting the fire alarm signal from the CPU 40 and supplying the fire alarm signal to each CPU 40 of the remaining ones of the plurality of slave fire alarm systems.

The temperature sensor 10 always senses the temperature of surroundings near the spot that the fire alarm system is installed within and accordingly on the occurrence of a sudden fire provides lower voltages than those usual to the comparator 20. At this time, the lower voltages are fed to the comparator 20, in which they are compared to a reference voltage level which was set up by the CPU 40, and according to its comparative result, a logic signal is provided to the buffer 30, in which this logic signal is buffered and inverted. Then, CPU 40 receives the logic signal from the buffer 30 and decides whether or not the spot is now in the fire situation, in which a fire alarm signal is fed to the host computer 80 and some continuous fire message data are supplied to the voice synthesizer 50. Once the message data from the CPU40 are fed to the voice synthesizer 50, their corresponding address signals are generated and supplied to the voice memory 60, and thereby voice data are taken out of the voice memory 60, and provided again to the voice synthesizer 50 to be synthesized into quantized voice messages which are received by the voice output amplifier 70. And the voice output amplifier 70 reshapes and amplifies the quantized voice messages supplied from the voice synthesizer 50, and accordingly, voice signals that inform of information about the fire spot and instructions for safety as well as give a fire alarm are provided in vocal alarm sounds.

Meanwhile, the host computer 80 senses the status of every slave fire alarm system according to the control program stored in itself, and on detecting a fire alarm signal from the CPU 40 it provides not only fire alarm signals but also messages related to information for safety to remaining fire alarm systems.

Figure 2:
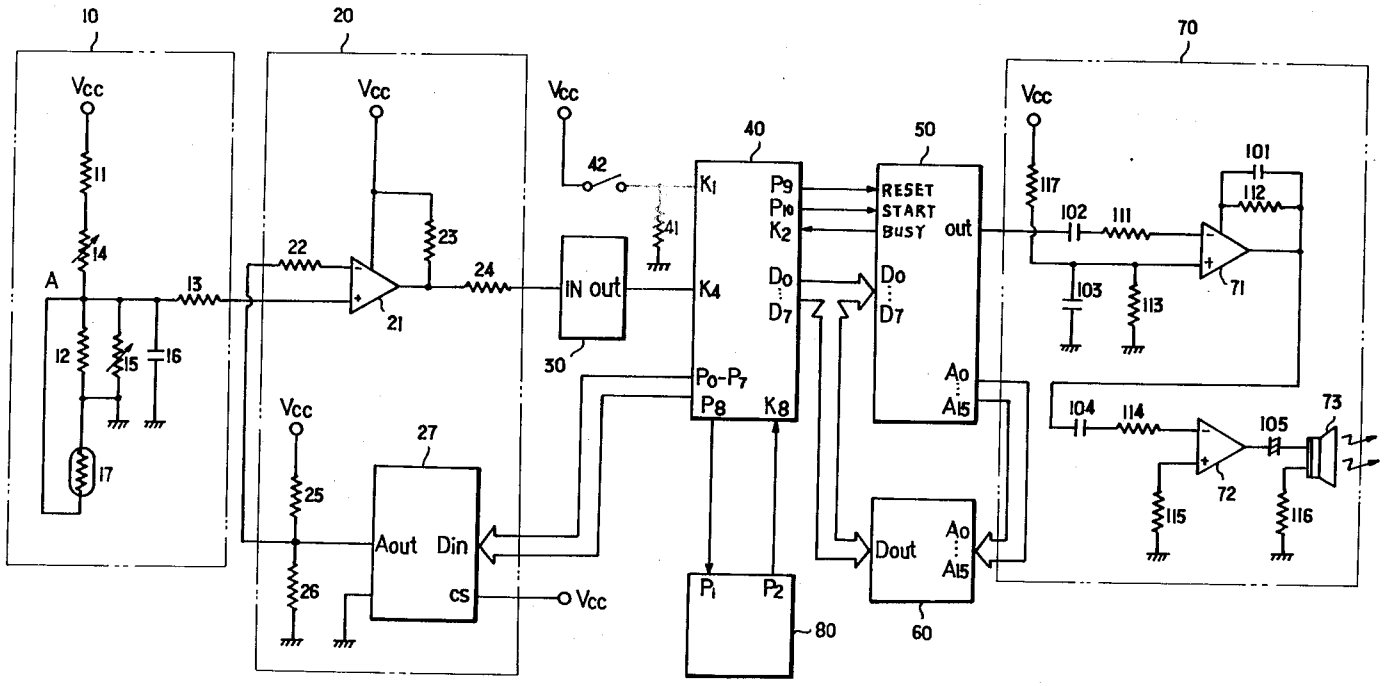
FIG. 2 is a schematic circuit diagram illustrating a preferred embodiment of the block diagram of FIG. 1.

Referring to FIG. 2 showing a schematic circuit diagram of a preferred embodiment of FIG. 1, the temperature sensor 10 has resistors 11—13, variable resistors 14–15, capacitor 16 and thermistor 17, and the comparator 20 has resistors 22–26, digital-to-analog converter 27 (hereinafter referred to as "D-A converter" and operational amplifier 21. Vcc represents a power supply source voltage.

Therefore, when a fire suddenly arises near the temperature sensor 10 in the fire alarm system, the thermistor 17 senses abnormally higher temperature more than that of its usual situation. The variation of its surrounding temperature which is sensed by the thermistor 17 makes its resistance change accordingly, so that in accordance with the variation of the resistance, a voltage on node A that is divided by resistor 11–12, variable resistor 14–15 and thermistor 17 from source voltage Vcc is fed to a positive input of the operational amplifier 21 through resistor 13. Herein, the voltage on node A inversely varies with the temperature that is sensed in the thermistor 17. On the other hand, to a negative input of the operational amplifier 21 is fed through resistor 22 an analog reference voltage that a digital reference voltage data taken out of the CPU 40 via ports $P_0$-$P_7$, is converted into the analog reference voltage by D-A converter 27 and thereof divided by resistors 25–26. Therefore, the operational amplifier 21 compares the voltage according to the variation of the temperature with the refrence voltage set up in advance in the CPU 40, and its resultant output signal is fed through resistor 23–24 to the buffer 30, wherein the output signal in the operational amplifier 21 is buffered and inverted. Because the thermistor 17 has negative resistive characteristics to the variation of the temperature, the voltage on the node A on a occurrence of fire goes lower than that in a normal situation, and thereby the output of the operational amplifier 21 falls into "low" logic level. This "low" logic level signal is inverted into a "high" logic level signal in the buffer 30 and fed to a input port K4 of the CPU 40. The CPU 40 that receives the "high" logic level signal from the buffer 30 gets it internal counter to initiate and to operate. If the "high" logic level to the input port K4 is maintained without any change for a specified interval of time, the CPU 40 itself decides that a fire has just arisen in the spot related to the fire alarm system and provides a "RESET" signal and a "START" signal to the voice synthesizer 50 through the output port P9 and P10. In the same instant that the CPU 40 outputs message data notifying the occurence of the fire in a vector addressing method to the voice synthesizer 50 via ports $D_0$-$D_7$, it provides a fire alarm signal through an output port P8 to the host computer 80. Once the data from the CPU 40 are entered into the voice synthesizer 50 in a vector addressing method, the voice synthesizer 50 generates address signals in accordance with the data entered in and feeds them to the voice memory 60 via ports $A_0$-$A_{15}$, and simultaneously provides to the CPU 40 a "BUSY" signal representing that it is now in operation. The voice memory 60 provides to the voice synthesizer 50 voice data corresponding to the address signals supplied from the voice synthesizer 50. In the mean time, the voice synthesizer 50 processes and synthesizes the voice data to be voice messages quantized, and then they are fed to a negative input of the operational amplifier 71 through capacitor 102 and resistor 111. In this moment, the "BUSY" signal provided to the CPU 40 is completely disconnected, and message data representing several items of information and instructions for coping with the fire situation and escaping the danger are again supplied to the voice synthesizer 50 in the vector addressing method by controls from the CPU 40. Also, the voice synthesizer 50 outputs the "BUSY" signal to the CPU 40 in like manner as explained above and provides its corresponding address signals to the voice memory 60. By this, the voice data related to the information and the instructions are again fed to the voice synthesizer 50 and therein synthesized into necessary quantized voice messages, and then they are supplied to the voice output amplifier 70.

Thereafter, the quantized voice messages are fed to the negative input of the operational amplifier 71 through capacitor 102 in series with resistor 111, and a positive input is supplied by source voltage Vcc which is divided by resistors 113, 117. The quantized voice message signals are reshaped and amplified in the operational amplifier 71 having resistor 112 in parallel with capacitor 101 that is to feedback its output signal, and then they are again supplied to a negative input of the operational amplifier 72 through capacitor 104 in series with resistor 114. The operational amplifier 72 again amplifies in the inverting mode the voice message signals supplied from the operational amplfier 71 and through capacitor 105 provides complete voice message signals to a speaker 73.

As a result, on the occurrence of a sudden fire in the spot near the fire alarm system, the abnormal variation of the temperature is sensed by the thermistor 17 and consequently the messages related to the information and the instructions for coping with the fire and escaping the danger, as well as the fire alarm signal itself are announced in voice from the speaker.

On the other hand, after the host computer 80 receives the fire alarm signal supplied from the output port P8 of the CPU 40, it checks the current time and date to thereof store that data into its internal memory and also provides the fire alarm signals and their related messages to the remaining slave fire alarm systems connected to itself.

As described above, even though there should not be any guidance from safety guards on an occurrence of a fire, the automatically announced information and instructions related to the fire situation give help to many to cope with and escape the danger. Moreover, data that is at the moment stored in the host computer helps to find out the cause of the occurrence of the fire on or after extinguishing the fire.

I claim:

1. A speaking fire alarm system for providing in voice not only warning signals but also information to cope with an emergent situation on an occurrence of a sudden fire, comprising:

temperature sensor for sensing surrounding temperature and providing a voltage in accordance with said temperature sensed;

comparator means for obtaining a comparative result by comparing said voltage supplied from said temperature sensor with a reference voltage and thereby providing a logic signal responsive to said comparative result;

a central processing unit for receiving said logic signal and deciding the occurrence of a fire, and providing both message data according to the emergent situation and fire alarm signals at the same time;

voice synthesizer means for providing address signals responsive to said message data supplied from said central processing unit and providing quantized voice messages synthesized from voice data received in response to said address signals;

voice memory means for providing to said voice synthesizer, said voice data stored at addresses corresponding to said address signals supplied from said voice synthesizer;

voice output amplifying means for receiving said quantized voice messages supplied from said voice synthesizer, for reshaping said quantized voice messages supplied, and for amplifying said quantized voice messages reshaped to an adequate level; and a host computer connected to said central processing unit and connectable to a plurality of slave fire alarm systems and having a control program for, upon reception of a fire alarm signal from one of said central processing unit and slave fire alarm systems, controlling said providing of message data by others of said central processing unit and slave fire alarm systems not providing a fire alarm signal to said host computer, by simultaneously providing said fire alarm signals in accordance with execution of said control program to others of said central processing unit and slave fire alarm systems not providing a fire alram signal.

2. The alarm of claim 1, further comprising:

said processing unit providing during a first phase of operation, said fire alarm signals to said host computer and a first type of message data to said voice synthesizer means, and during a second phase of said operation, providing a second type of message data to said voice synthesizer means; and said voice synthesizer means transmitting a busy signal to said processing unit upon reception of said first type of message data, addressing said voice memory means with address signals determined by said first type of message data, receiving a first type of voice data from said voice memory means, and generating a first type of quantized voice messages on the basis of said first type of voice data.

3. The alarm of claim 2, further comprising said voice synthesizer means discontinuing transmission of said busy signal to said processing unit upon generating said first type of quantized voice messages.

4. The alarm of claim 2, further comprising said voice synthesizer means transmitting said busy signal to said processing unit upon reception of said second type of said message data, receiving a second type of voice data from said voice memory means, and generating a second type of quantized voice messages on the basis of said second type of voice data.

5. The alarm of claim 4, further comprising said voice synthesizer means discontinuing transmission of said busy signal to said processor means upon generating said second type of quantized voice messages.

6. The alarm of claim 1, wherein said host computer includes an internal memory and, upon receiving said alarm signals, said host computer stores current time and date.

7. The alarm of claim 1, wherein said host computer, upon receiving said fire alarm signals from one of said slave fire alarm systems, provides both fire alarm signals and message data about safety to others of said slave fire alarm systems.

8. The alarm of claim 1, further comprising:

said processing unit providing, during a first phase of operation, said fire alarm signals to said host computer and message data notifying said voice synthesizer means about the occurrence of a fire, and during a second phase of said operation, providing said voice synthesizer means with message data containing information and instructions about coping with the fire; and said voice synthesizer means transmitting a busy signal to said processing unit upon reception of said message data about the occurrence of a fire, addressing said voice memory means with address signals determined by said message data about the occurrence of a fire, receiving from said voice memory means voice data about the occurrence of the fire, and generating quantized voice messages on the basis of said voice data about the occurrence of the fire.

9. The alarm of claim 8, further comprising said voice synthesizer means discontinuing transmission of said busy signal to said processing unit upon generating said quantized voice messages on the basis of said voice data about the occurrence of the fire.

10. The alarm of claim 8, further comprising said voice synthesizer means transmitting said busy signal to said processing unit upon reception of said message data containing information and instruction about coping with the fire, addressing said voice memory means with address signals determined by said message data containing information and instructions about coping with the fire, receiving voice data containing information and instruction about coping with the fire from said voice memory means, and generating quantized voice messages on the basis of said voice data containing information about coping with the fire.

11. The alarm of claim 10, further comprising said voice synthesizer means discontinuing transmission of said busy signal to said processing unit upon generating said quantized voice messages on the basis of said voice data containing information about coping with the fire.

12. The alarm of claim 11, wherein said host computer includes an internal memory and, upon receiving said alarm signals, said host computer stores current time and date.

13. The alarm of claim 12, wherein said host computer, upon receiving said fire alarm signals from one of said slave fire alarm systems, provides both fire alarm signals and message data about safety to others of said slave fire alarm systems.

14. A fire alarm, comprising:

a plurality of fire detection systems, each comprising:

sensor means for providing a sensor signal representative of an ambient temperature;

means for making a comparison of said sensor signal and a reference signal and for providing a logic signal in response to said comparison;

processing means for generating said reference signal, for receiving and determining on the basis of said logic signal, the occurence of a fire, at the same time providing both alarm signals and message data;

memory means for storing and providing voice data in response to reception of corresponding address signals;

synthesizer means for receiving said message data, addressing said memory with address signals determined by said message data, receiving voice data from said memory means, and generating quantized voice messages on the basis of said voice data; and means for broadcasting said quantized voice messages as vocal sounds; and control means for monitoring a plurality of said fire detection systems and for receiving said alarm signals, and for applying control signals to others of said fire detection systems upon reception of a fire alarm signal.

15. The alarm of claim 14, further comprising:

said processor means providing during a first phase of operation, said alarm signals to said control means and a first type of message data to said synthesizer means, and during a second phase of said operation, a second type of message data to said synthesizer means; and said synthesizer means transmitting a busy signal to said processor means upon reception of said first type of message data, addressing said memory means with address signals determined by the type of said message data, re first type of message data, addressing said memory means with address signals determined by the type of said message data, re first type of message data, addressing said memory means with address signals determined by the type of said message data, receiving a first type of voice data from said memory means, and generating a first type of quantized voice messages on the basis of said first type of voice data.

16. The alarm of claim 15, further comprising said synthesizer means discontinuing transmission of said busy signal to said processor means upon generating said first type of quantized voice messages.

17. The alarm of claim 15, further comprising said synthesizer means transmitting said busy signal to said processor means upon reception of said second type of message data, addressing said memory means with address signals determined by said second type of message data, receiving a second type of voice data from said memory means, and generating a second type of quantized voice messages on the basis of said second type of voice data.

18. The alarm of claim 17, further comprising said synthesizer means discontinuing transmission of said busy signal to said processor means upon generating said second type of quantized voice messages.

19. The alarm of claim 14, wherein said control means includes an internal memory and, upon receiving said alarm signals, said control means stores current time and date.

20. The alarm of claim 14, wherein said control means, upon receiving said alarm signals from one of said fire detection systems, provides both alarm signals and message data about safety to others of said fire detection systems.

21. The alarm of claim 14, further comprising:

said processor means providing during a first phase of operation, said alarm signals to said control means and message data notifying said synthesizer means about the occurrence of a fire, and during a second phase of said operation, providing said sythesizer means with message data containing information and instructions about coping with the fire; and said synthesizer means transmitting a busy signal to said processor means upon reception of said message data about the occurrence of a fire, addressing said memory means with address signals determined by said message data about the occurrence of a fire, receiving from said memory means voice data about the occurrence of the fire, and generating quantized voice messages on the basis of said voice data about the occurrence of the fire.

22. The alarm of claim 21, further comprising said synthesizer means discontinuing transmission of said busy signal to said processor means upon generating said quantized voice messages on the basis of said voice data about the occurrence of the fire.

23. The alarm of claim 21, further comprising said synthesizer means transmitting said busy signal to said processor means upon reception of said message data containing information and instructions about coping with the fire, addressing said memory means with address signals determined by said message data containing information and instructions about coping with the fire, receiving voice data containing information and instructions about coping with the fire from said memory means, and generating quantized voice messages on the basis of said voice data containing information about coping with the fire.

24. The alarm of claim 23, further comprising said synthesizer means discontinuing transmission of said busy signal to said processor means upon generating said quantized voice messages on the basis of said voice data containing information about coping with the fire.

25. The alarm of claim 24, wherein said control means includes an internal memory and, upon receiving said alarm signals, said control means stores current time and date.

26. The alarm of claim 25, wherein said control means, upon receiving said alarm signals from one of said fire detection systems, provides both alarm signals and message data about safety to others of said fire detection systems.

* * * * *

UNITED STATES PATENT AND TRADEMARK OFFICE

CERTIFICATE OF CORRECTION

PATENT NO. : 4,816,809
DATED : March 28, 1989
INVENTOR(S) : Jin-Seak Kim

It is certified that error appears in the above-indentified patent and that said Letters Patent is hereby corrected as shown below:

| | | |
|---|---|---|
| Column 1, | Line 43, | after "situation," , delete " , comprising:" and insert --.The system includes a--; |
| Column 3, | Line 14, | after "converter"", insert --)--; and |
| Column 4, | Line 55, | before "moment", change "the" to --that--: |
| Claim 15, thru | Line 30 Line 35, | after "data," (line 30) and before "receiving" (line 35), delete --re first type of message date, addressing said memory means with address signals determined by the type of said message data, re first type of message data, addressing said memory means with address signals determined by the type of said message data, -- |

Signed and Sealed this

Third Day of June, 1997

*Attest:*

*Attesting Officer*

Bruce Lehman

BRUCE LEHMAN

*Commissioner of Patents and Trademarks*